United States Patent [19]

Kozuki

[11] Patent Number: 4,763,554

[45] Date of Patent: Aug. 16, 1988

[54] AUTOMATIC RHYTHM PERFORMING APPARATUS FOR ELECTRONIC MUSICAL INSTRUMENT

[75] Inventor: Koichi Kozuki, Hamamatsu, Japan

[73] Assignee: Nippon Gakki Seizo Kabushiki Kaisha, Hamamtsu, Japan

[21] Appl. No.: 946,384

[22] Filed: Dec. 23, 1986

[30] Foreign Application Priority Data

Dec. 30, 1985 [JP] Japan ..... 60-298772

[51] Int. Cl.[4] ..... G10H 1/42; G10H 7/00

[52] U.S. Cl. ..... 84/1.03; 84/DIG. 12

[58] Field of Search ..... 84/1.03, DIG. 12

[56] References Cited

FOREIGN PATENT DOCUMENTS 51-63612 6/1976 Japan .
58-8515 2/1983 Japan .

*Primary Examiner*—S. J. Witkowski
*Attorney, Agent, or Firm*—Spensley Horn Jubas & Lubitz

[57] ABSTRACT

For use in or with an electronic musical instrument, an automatic rhythm performing apparatus is so constructed as to provide selectively automatic performance of various kinds of rhythms using tones of a plurality of rhythm section instruments. Each rhythm is constructed with a plurality of instruments, which are divided into several families. Plural rhythm patterns are provided for each of the rhythm instrument tones which constitute one kind of rhythm. Any one of the rhythm patterns is selected for each instrument, and such selection is available individually family by family of the instruments. Thus a variety of automatic rhythm performance can be realized with small scale pattern memories and simple selecting operations.

5 Claims, 9 Drawing Sheets

| TYPE OF RHYTHM | RHYTHM NUMBER n | TYPE OF RHYTHM | RHYTHM NUMBER n |
|---|---|---|---|
| POPS | 0 | BOSSANOVA | 6 |
| DISCO | 1 | REGGAE | 7 |
| 16-BEATS | 2 | BIG-BAND | 8 |
| ROC'N ROLL | 3 | SLOW ROCK | 9 |
| COUNTRY | 4 | MARCH | 10 |
| LATIN | 5 | WALTZ | 11 |

FIG. 3

| TONE-PRODUCING CHANNEL / TYPE OF RHYTHM (n) | ch 1 | ch 2 | ch 3 | ch 4 | ch 5 | ch 6 |
|---|---|---|---|---|---|---|
| POPS (0) | 1 | 2 | 4 | 10 | 11 | 14 |
| DISCO (1) | 1 | 2 | 10 | 11 | 15 | 16 |
| 16-BEATS (2) | 1 | 2 | 10 | 11 | 8 | 9 |
| ROC'N ROLL (3) | 1 | 2 | 4 | 10 | 11 | 17 |
| COUNTRY (4) | 1 | 2 | 6 | 10 | 11 | 15 |
| LATIN (5) | 1 | 7 | 8 | 9 | 12 | 18 |
| BOSSANOVA (6) | 1 | 2 | 6 | 10 | 13 | 12 |
| REGGAE (7) | 1 | 2 | 4 | 6 | 10 | 3 |
| BIG-BAND (8) | 1 | 2 | 13 | 10 | 6 | |
| SLOW ROCK (9) | 1 | 2 | 10 | 11 | 15 | |
| MARCH (10) | 1 | 5 | 2 | 10 | 11 | 13 |
| WALTZ (11) | 1 | 2 | 13 | 10 | 11 | 15 |

FIG. 4

| TONE GENERATOR GROUP NUMBER "J" | | 1 | 2 | 3 | 4 |
|---|---|---|---|---|---|
| POPS (n=0) | ACCENT | 1 | 0 | 0 | 0 |
| | (NON-USE) | 0 | 0 | 0 | 0 |
| | CLAV | 0 | 0 | 0 | 1 |
| | B D | 1 | 0 | 0 | 0 |
| | S D | 0 | 1 | 0 | 0 |
| | M·TOM | 0 | 1 | 0 | 0 |
| | HHO | 0 | 0 | 1 | 0 |
| | HHC | 0 | 0 | 1 | 0 |
| DISCO (n=1) | ACCENT | 1 | 0 | 0 | 0 |
| | (NON-USE) | 0 | 0 | 0 | 0 |
| | H·CLAP | 0 | 0 | 0 | 1 |
| | B D | 1 | 0 | 0 | 0 |
| | S D | 0 | 1 | 0 | 0 |
| | CLAP | 0 | 0 | 0 | 1 |
| | HHO | 0 | 0 | 1 | 0 |
| | HHC | 0 | 0 | 1 | 0 |

FIG. 5

ONE BAR (MEASURE)
( ♪ x 16 )

| PATTERN NUMBER "1" | | ♪ 1 | 2 | 3 | 4 | 5 | ♪ 1 | 2 | 3 | 4 | 5 | ♪ 1 | 2 | 3 | 4 | 5 | ♪ 1 | 2 | 3 | 4 | 5 | ♪ 1 | 2 | 3 | 4 | 5 | ♪ 1 | 2 | 3 | 4 | 5 |
|---|---|---|---|---|---|---|---|---|---|---|---|---|---|---|---|---|---|---|---|---|---|---|---|---|---|---|---|---|---|---|---|
| POPS (n=0) | ACCENT | [1] | 1 | 1 | 1 | 1 | 0 | 0 | 0 | 0 | 0 | 1 | 1 | 1 | 1 | 1 | 0 | 0 | 0 | 0 | 0 | 1 | 1 | 1 | 1 | 1 | 0 | 0 | 0 | 0 | 0 |
| | (NON-USE) | 0 | 0 | 0 | 0 | 0 | 0 | 0 | 0 | 0 | 1 | 0 | 0 | 0 | 0 | 0 | 0 | 0 | 0 | 0 | 0 | 0 | 0 | 0 | 0 | 0 | 0 | 0 | 0 | 0 | 0 |
| | CLAV | 0 | 1 | 1 | [1] | 1 | 0 | 0 | 0 | 0 | 0 | 0 | 0 | 0 | 1 | 1 | 0 | 0 | 0 | 0 | 0 | 0 | 1 | 1 | 0 | 1 | 0 | 0 | 0 | 0 | 0 |
| | BD | [1] | 1 | 1 | 1 | 1 | 0 | 0 | 0 | 0 | 0 | 0 | 1 | 0 | 0 | 0 | 0 | 0 | 0 | 0 | 0 | 0 | 0 | 0 | 0 | 1 | 0 | 0 | 0 | 0 | 0 |
| | SD | 0 | [0] | 0 | 0 | 0 | 0 | 0 | 0 | 0 | 0 | 0 | 0 | 0 | 0 | 0 | 0 | 0 | 0 | 1 | 0 | 1 | 0 | 1 | 0 | 1 | 0 | 0 | 0 | 0 | 0 |
| | M·TOM | 0 | [0] | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | HHO | [0] | 0 | 0 | 0 | 0 | 0 | 0 | 0 | 0 | 0 | 0 | 0 | 0 | 1 | 1 | 0 | 0 | 0 | 0 | 0 | 0 | 0 | 0 | 0 | 0 | 0 | 0 | 0 | 0 | 0 |
| | HHC | [1] | 1 | 1 | 1 | 1 | 0 | 0 | 0 | 0 | 0 | 1 | 1 | 0 | 0 | 0 | 0 | 0 | 0 | 0 | 0 | 1 | 1 | 1 | 1 | 1 | 0 | 0 | 0 | 0 | 0 |
| DISCO (n=1) | ACCENT | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 |
| | (NON-USE) | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | H·CLAP | 0 | 0 | 0 | 0 | 0 | 0 | 0 | 0 | 0 | 0 | 0 | 0 | 0 | 0 | 0 | 0 | 0 | 0 | 0 | 0 | 0 | 1 | 1 | 0 | 0 | 0 | 0 | 0 | 0 | 0 |
| | BD | 1 | 1 | 1 | 1 | 1 | 0 | 0 | 0 | 0 | 1 | 0 | 0 | 1 | 1 | 1 | 0 | 0 | 1 | 1 | 1 | 1 | 0 | 0 | 0 | 0 | 0 | 0 | 1 | 1 | 0 |
| | SD | 0 | 0 | 0 | 0 | 0 | 0 | 0 | 0 | 0 | 0 | 0 | 0 | 0 | 0 | 0 | 0 | 0 | 0 | 0 | 0 | 1 | 1 | 0 | 1 | 1 | 0 | 0 | 0 | 0 | 0 |
| | CLAP | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 1 | 0 | 0 | 0 | 0 | 0 | 0 |
| | HHO | 0 | 0 | 0 | 0 | 0 | 0 | 0 | 0 | 0 | 0 | 1 | 0 | 0 | 1 | 1 | 0 | 0 | 0 | 0 | 0 | 0 | 0 | 0 | 0 | 0 | 0 | 0 | 0 | 0 | 0 |
| | HHC | 1 | 0 | 1 | 1 | 1 | 0 | 0 | 0 | 0 | 0 | 0 | 1 | 1 | 0 | 0 | 0 | 0 | 1 | 0 | 0 | 1 | 0 | 1 | 1 | 1 | 0 | 0 | 0 | 1 | 0 |

FIG. 6

AUTOMATIC RHYTHM PERFORMING APPARATUS FOR ELECTRONIC MUSICAL INSTRUMENT

BACKGROUND OF THE INVENTION (a) Field of the Invention

The present invention relates to an automatic rhythm performing apparatus for use in or with an electronic musical instrument, and more particularly, to an improvement in the rhythm pattern alteration control system of the above-mentioned apparatus.

(b) Description of the Prior Art

There has been known the technique which, for the purpose of materializing automatic rhythm performance rich in variation, is of the construction that, along with memorized principal rhythm patterns, their diversive variation patterns are stored in a memory, and that desired appropriate variation patterns are selectively read out from this memory.

Also, as another prior art methods of materializing variation-rich automatic rhythm performance, there have been provided an arrangement designed to allow the user to set (amend) a part or section of a whole rhythm pattern for each type of tone generator, i.e. for each type of rhythm instrument (e.g. Japanese Patent Preliminary Publication No. Sho 51-63612), and also an arrangement designed to allow the user to arbitrarily set (compose) desired rhythm patterns (e.g. Japanese Patent Publication No. Sho 58-8515).

According to the above-mentioned prior art method designed to selectively read out one of these stored variation patterns, a large number of different variation rhythm patterns are required to be stored in a memory to obtain many pattern variations, so that there arises the inconvenience that a memory of a large capacity has to be provided.

Also, in the above-mentioned type prior art constructions which are designed to allow the user to arbitrarily set either the whole or a part of rhythm patterns, the arrangement is so designed that the patterns are set by first designating the rhythm timings and then for each timing the tone generators (rhythm instruments) to be used are designated. Therefore, while there can be enjoyed a great freedom in setting desired modified patterns, this is entailed by a complexity in the setting operation, which has made these prior art mechanisms difficult to operate especially by the beginners.

SUMMARY OF THE INVENTION

It is, therefore, an object of the present invention to provide an automatic rhythm performing apparatus for use in or with an electronic musical instrument, which makes it possible to materialize an automatic rhythm performance rich in variation, by the provision of a memory of a reduced capacity and by a simplified manipulating operation.

BRIEF DESCRIPTION OF THE DRAWINGS

FIGS. 3, 4, 5, 6 and 8 show the contents of the first, second, third, fourth and fifth tables in a table memory employed in the embodiment of the present invention.

DETAILED DESCRIPTION OF THE INVENTION

Figure 1:
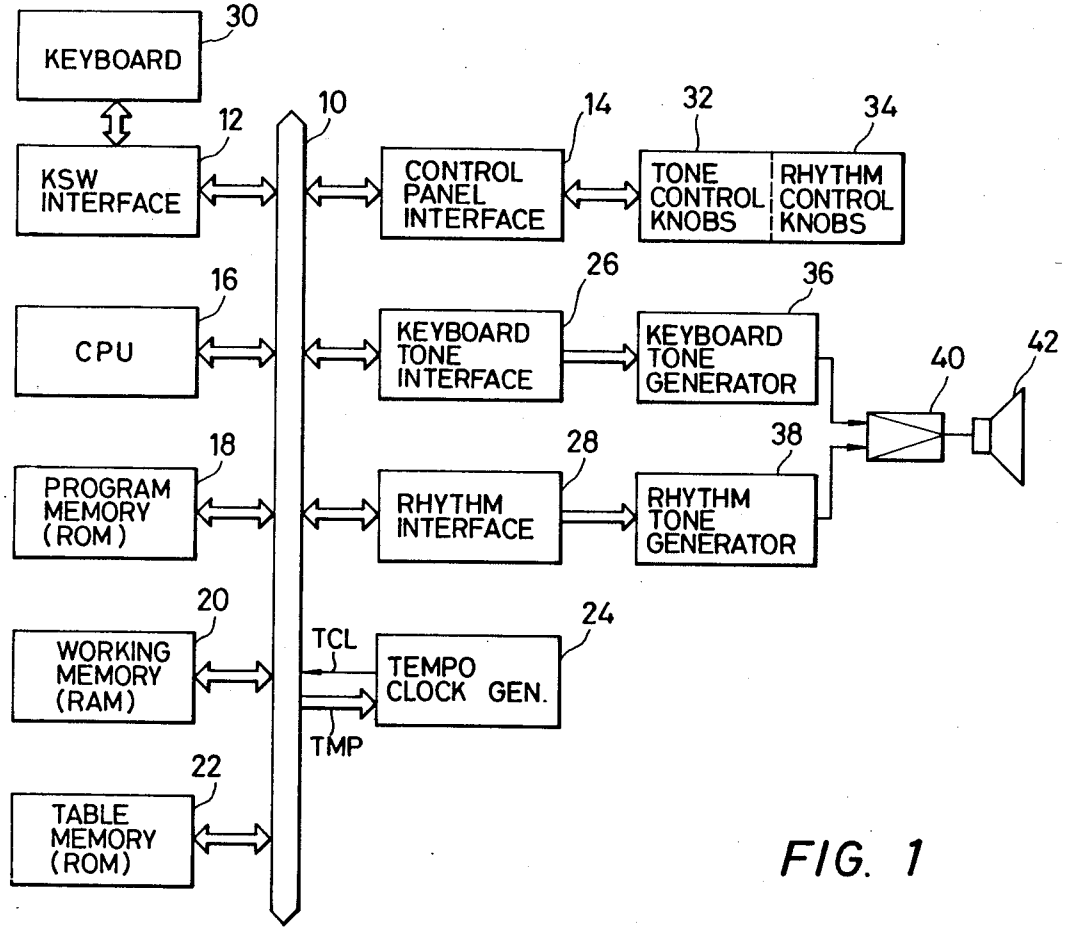
FIG. 1 is a block diagram showing the circuit arrangement of an electronic musical instrument equipped with an automatic rhythm performing apparatus according to an embodiment of the present invention.

Before making a detailed description of the present invention, the system thereof will be briefed as follows. According to the present invention, there is provided a system arranged so that a plurality of tone generators representing various kinds of musical rhythm instruments which are used for the performance of each rhythm, e.g. "pops", are grouped into a plurality of tone category families (for example, four families such as bass drum family, snare drum family, cymbal family and extra family) and they are stored in a memory requiring a relatively small capacity, and that from among the memorized plurality of (for example, five) rhythm patterns for each od said rhythm instruments (hereinafter to be referred to simply as tone generators), an arbitrary rhythm pattern is selected so that the tone generator driving pulses at individual tone-producing timings for the selected rhythm are determined automatically, whereby making a rhythm performance rich in variation.

The automatic rhythm performing apparatus according to the system of the present invention comprises rhythm pattern selecting means, a first and a second memory means, driving data forming means and rhythm tone generator means.

The rhythm pattern selecting means is so constructed that a plurality (eighteen in all) of rhythm tone instruments (hereinafter to be called tone generators) which are to be used for the performance of desired rhythms are divided or grouped into a reduced number of instrument (tone type) families, and for each tone type family thus grouped, an arbitrary set of rhythm patterns is selected by the user from among a plurality of sets of the rhythm patterns. The manner of dividing or grouping the tone generators may be either one of the following three: (1) each tone type family consists of a single tone generator; (2) each tone type family consists of a plurality of tone generators; and (3) some tone type families consist of a single tone generator, while other families consist of a plurality of tone generators.

The first memory means is designed to store tone generator versus family designation data (hereinafter: "family designation data") for the respective instrument families. Arrangement is so provided that the family designation data designate which family the respective tone generators belong to.

The second memory means is intended to store the rhythm pattern data for a plurality of rhythm patterns. Arrangement is so provided so that the rhythm pattern data include rhythm patterns for a plurality of rhythms, that each rhythm is composed with a plurality of instruments, that plural rhythm patterns are provided for each instrument, and that each rhythm pattern indicates the tone producing timings for the allotted instrument.

The driving data forming means is intended to form tone generator driving data indicating which ones of the tone generators are to be driven at individual tone-producing timings, based on the rhythm pattern data of the specific rhythm pattern which has been selected, family by family, by the pattern selecting means and designated by the family designation data.

The rhythm tone generator means is provided to generate tone signals of the respective rhythm instruments by being selectively driven in accordance with the thus-formed tone generator driving data.

According to the construction of a system of the present invention, rhythm patterns are selected first for each family of tone generators, and based on the rhythm pattern data corresponding to the thus-selected rhythm pattern and also based on the family designation data of the plurality of families of tone generators, tone generator driving data are formed. Therefor, the tone generator driving pattern for each tone-producing timing is determined depending on which ones of the rhythm patterns for the respective families of tone generators have been selected, whereby making it possible to realize a rhythm performance greatly abundant in variation. That is, let us here assume that the number of the rhythm patterns is "I", and that the number of the families of tone generators is "J". As described above, since selection of a rhythm pattern is possible for each family of tone generators, there can be obtained tone generator driving patterns in a number which is as many as "I raised to the J-th power " (if, for example, I=5, and J=4, there are $5^4$ kinds of tone generator driving patterns). The user is able to materialize a rhythm performance by appropriately setting before or during the midst of a performance, an arbitrary one or ones from among these tone generator driving patterns.

In the present invention, it should be noted that a number of tone generator driving patterns per se as mentioned above are not stored in the memory, but instead, the contents to be stored in the memory consist of only the family designation data corresponding to the plurality of instrument families and the rhythm pattern data for the respective instruments. Therefore, the memory capacity can be reduced to a great extent.

Also, in the present invention, arrangement is provided so that rhythm patterns are selectable for family by family of the tone generators. Thus, as compared to the arrangement of the prior art system which requires the user to operate a desired one from among a number of variation pattern selection switches, or to the arrangement designed to firstly designate a desired tone-producing timing and to secondly designate tone generators which are to be sounded out, the pattern changing operation (manipulations) in the present invention is extremely simplified.

EXAMPLE

FIG. 1 shows a circuit arrangement of an electronic musical instrument equipped with an automatic rhythm performing apparatus according to an embodiment of the present invention. This electronic musical instrument is constructed so that both keyboard tone generation and rhythm tone generation are controlled by the aid of a microcomputer.

CIRCUIT ARRANGEMENT (FIG. 1)

To a bus line 10 are connected a key switch (KSW) interface 12, a control panel interface 14, a central processing unit (CPU) 16, a program memory 18, a working memory 20, a table memory 22, a tempo clock generator 24, a keyboard tone interface 26 and a rhythm interface 28.

The KSW interface 12 is intended to scan a number of key switches provided correspondingly to a number of keys on a keyboard 30 to detect key actuations.

The control panel interface 14 is intended to scan a number of tone control knobs 32 and a number of rhythm control knobs 34 which are both provided on the control panel face of the electronic musical instrument to detect knob actuations in the control panel. The arrangement of the numerous rhythm control knobs (switch buttons) on the panel face will be described later by referring to FIG. 2.

The CPU 16 is assigned to carry out various kinds of processing for the purpose of keyboard tone generation and rhythm tone generation in accordance with the program stored in the program memory 18 which is comprised of ROM (Read Only Memory). These kinds of processing will be described later by referring to FIGS. 9 to 11.

The working memory 20 is comprised of RAM (Random Access Memory), and includes those parts which function as counters, registers and so forth which are utilized for the various kinds of processing by CPU 16. These functioning parts will be described later.

The table memory 22 is composed of ROM, which stores first to fifth tables with respect to the generation of rhythm tones. These tables will be described later by referring to FIGS. 3 to 8.

Figure 11:
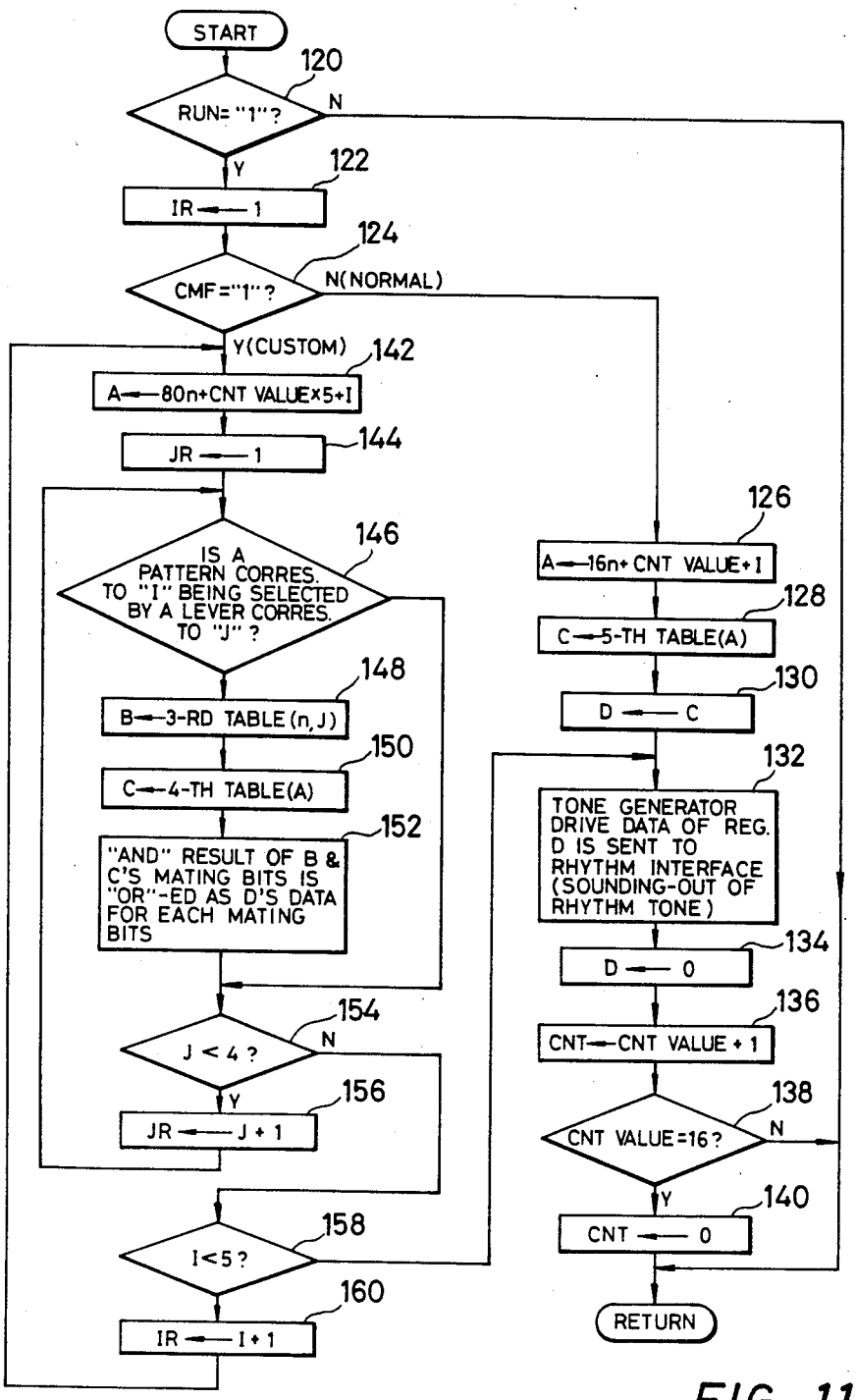
FIG. 11 is a flow chart showing the tempo interrupt routine.

The tempo clock generator 24 is constructed so as to generate tempo clock pulses TCL in accordance with the tempo determined in compliance to the tempo data TMP. These tempo clock pulses TCL are utilized as an interrupt command signal. That is, at each time a tempo clock pulse TCL is generated, the tempo interrupt routine of FIG. 11 is carried out, whereby making it possible to produce rhythm instrument tones.

The keyboard tone interface 26 is assigned to supply, to a keyboard tone forming (generating) circuit 36, such data as tone pitch data, tone color data and tone volume data based on the key actuation informations detected via the KSW interface 12 and also based on the tone control manipulation informations detected via the control panel interface 14. The keyboard tone generating circuit 36 is assigned to form (generate) tone signals in compliance to these supplied data.

The rhythm interface 28 is to supply, to a rhythm tone producing circuit 38, such data as rhythm generator assignment data of the selected rhythm and the rhythm tone generator driving data indicative of which rhythm tone generators are to be driven at individual timings. The rhythm tone producing circuit 38 is constructed to generate rhythm instrument tone signals in accordance with these supplied data. The rhythm tone producing circuit 38, as an example, possesses six (6) time-divisional tone-producing channels and also includes eighteen (18) tone generators (waveshape storage parts storing each of, for example, eighteen (18) kinds of percussion instrument waveshapes). To these six (6) tone-producing channels are assigned six (6) tone generators, respectively, in accordance with the tone generator assignment data corresponding to the selected rhythm. These six (6) tone generators thus assigned are selectively driven in accordance with the tone generator driving data dealing with the selected rhythm (for example, reading-out of waveshape is carried out), whereby enabling rhythm tone generation using six (6) tone generators.

The keyboard tone signals which come from the keyboard tone generating circuit 36 and the rhythm tone signals supplied from the rhythm tone producing circuit 38 are supplied to a loudspeaker 42 via an output amplifier 40 to be converted to sounds.

RHYTHM CONTROL MANIPULATOR KNOBS ARRANGEMENT SECTOR (FIG. 2)

Figure 2:
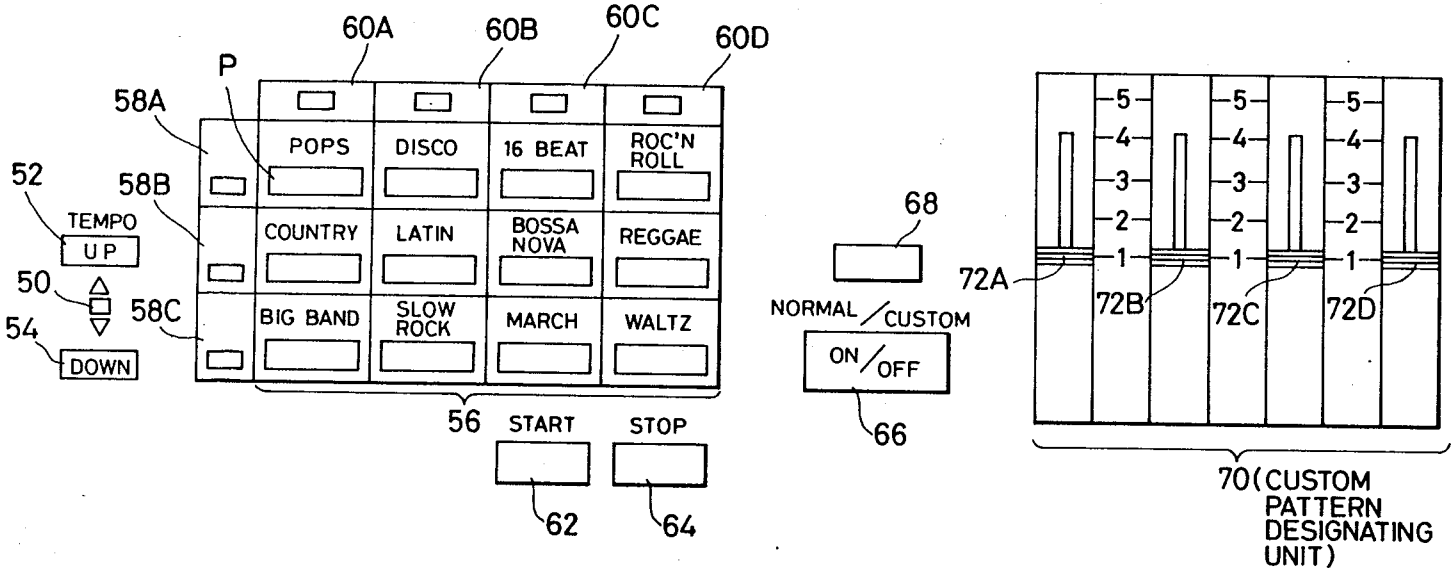
FIG. 2 is a diagrammatic plan view showing an example of arrangement layout of rhythm control manipulator knobs provided on the panel surface of the electronic musical instrument.

FIG. 2 shows the manner of arrangement of a number of rhythm control manipulator knobs and buttons on the control panel face.

Sandwiching a tempo indicator 50, there is provided, on one side of this indicator 50, a tempo adjusting switch 52 for upping (fastening) a tempo, and there is provided, on the other side of the tempo indicator 50, another tempo adjusting switch 54 for downing (slowing) a tempo.

On the right side (in FIG. 2) of the tempo adjusting switches 52 and 54, there is provided a rhythm kind indicating unit 56 wherein various rhythm kind indicators corresponding, respectively, to twelve (12) rhythms such as pops, disco, 16-beats and so on are arranged in a matrix form. Correspondingly to three horizontal rows of the rhythm kind indicators, there are provided three (3) rhythm selection switches 58A~58C. In addition, correspondingly to the four (4) vertical columns of the rhythm kind indicators, there are provided four (4) rhythm selection switches 60A~60D, respectively.

In order to select, for example, "pops" as the kind of rhythm for a performance, it is only necessary to actuate the rhythm selection switches 58A and 60A. By doing so, the specific rhythm kind indicator P corresponding to "pops" is lighted up. The selection of other kinds of rhythms can be accomplished in a manner similar to that operation mentioned above. By actuating each one pair of rhythm selection switches arranged on the upper and lateral sides of the matrix, a desired kind of rhythm can be designated.

On this side of the rhythm kind indicating unit 56, there are provided, in side-by-side fashion, a rhythm start switch 62 and a rhythm stop switch 64.

On the right side of the rhythm kind indicating unit 56, a normal/custom mode changeover switch 66 is provided. By turning this switch 66 on, the normal mode is selected, and a normal mode indicator 68 is lighted up. Also, upon turning the switch 66 off, the custom mode is selected, and the normal mode indicator 68 is put out. The normal mode is one for a rhythm performance played in accordance with a standard rhythm pattern for each kind of rhythm, while the custom mode is one for a rhythm performance played in accordance with various variation patterns (custom patterns) for each kind of rhythm.

On the right side of the mode changeover switch 66 is provided a custom pattern designating unit 70 for designating various types of custom patterns when a custom mode is selected. The custom pattern designating unit 70 includes, for example, pattern selection levers 72A~72D corresponding to four (4) tone generator families. The user is allowed to select an arbitrary from among five (5) rhythm patterns for each pattern selection lever (for each group of tone generators). Each custom pattern is determined depending on the position "1"~"5" at which one of the respective pattern selection levers 72A~72D (i.e. depending on which one of the five rhythm patterns is selected) is placed, and accordingly there can be provided $5^4$ kinds of custom patterns which can be set for performance.

MEMORIZED CONTENTS OF TABLE MEMORY 22 (FIGS. 3 TO 8)

FIG. 3 shows the memorized contents of the first table in the table memory 22. In this first table, there are stored those data indicative of the rhythm numbers "n" such as 0, 1, . . . , 11 correspondingly to the twelve (12) kinds of rhythms such as pops, disco, . . . , waltz.

FIG. 4 shows the memorized contents of the second table in the table memory 22. In this second table, there are stored those data indicative of the tone generator numbers "m" in the form of "1", "2", "4" and so on, representing the tone generators which are to be assigned to the six (6) tone-producing channels $ch_1 \sim ch_6$ for each kind of rhythm with respect to the twelve (12) kinds of rhythms stored in the first table. Here, the tone generator number "m" is preliminarily determined for each of the tone generators (rhythm instruments) in such a corresponding relationship as enumerated below.

| Instrument number "m" | Instrument name |
|---|---|
| 1 | Bass drum (BD) |
| 2 | Snare drum (SD) |
| 3 | High tom-tom |
| 4 | Middle tom-tom (M · TOM) |
| 5 | Low tom-tom |
| 6 | Rim |
| 7 | Bongo |
| 8 | High conga |
| 9 | Low conga |
| 10 | High hat open (HHO) |
| 11 | High hat closed (HHC) |
| 12 | Cabaza |
| 13 | Cymbal |
| 14 | Claves (CLAV) |
| 15 | Hand clap (H. CLAP) |
| 16 | Clapper (CLAP) |
| 17 | High agogo |
| 18 | Low agogo |

Figure 8:
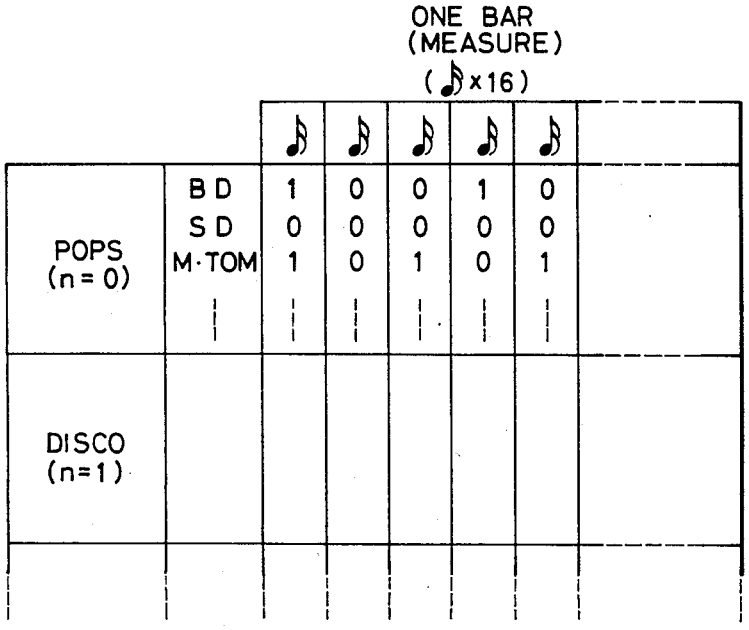

In the above-mentioned table, the parenthesized items represent abbreviations of the tone generator (instrument) names, which are appropriately referred to in FIGS. 5, 6 and 8.

FIG. 5 shows the contents of memory of the third table in the table memory 22. In this third table, there are stored tone generator (instrument) allotment data for the four (4) instrument families (tone generator group number $J=1 \sim 4$) for each rhythm of the twelve (12) types (kinds) of rhythms stored in the first table. Each tone generator (instrument) allotment datum is an 8-bit datum, wherein the most significant bit indicates, by "1" or "0", the need or no-need of addition of accent; and the lesser significant 6 bits designate by "1" those tone generators (instruments)—either a single or a plurality of tone generators from among six (6) tone generators—belonging to each tone generator group (instrument family). For example, with respect to the rhythm "pops", the tone generator allotment datum of the tone generator group number $J=1$ is such that the most significant bit indicates the presence of addition of accent by "1", and the 5-th bit counted from the least significant bit designates bass drum (BD) by "1". Also, the tone generator allotment datum $J=2$ designates snare drum (SD) and middle tom-tom (M·TOM), and the tone generator allotment datum $J=3$ designates "high hat open" (HHO) and "high hat closed" (HHC), while the tone generator allotment datum J=4 designates "claves" (CLAV).

FIG. 6 shows the memorized contents of the fourth table in the table memory 22. In this fourth table, there are stored those rhythm pattern data corresponding to five (5) kinds of rhythm patterns (pattern number I=1~5) for every instrument constituting each rhythm among the twelve (12) rhythms in the first table. Each rhythm pattern datum indicates a rhythm pattern for the length of one bar (measure), and is of the arrangement that it indicates, by either "1" or "0", the need or no-need of accentuation at each tone-producing timing corresponding to a 16-th note duration (beating) and also the need or no-need of sounding-out of the six (6) tone generators (instruments). Also, the pattern datum for a single tone-producing timing is an 8-bit datum, wherein the most significant bit indicates the need or no-need of accentuation, and the lesser significant six (6) bits correspond to the six (6) tone generators (instruments), in a manner similar to that tone generator allotment data described above. For example, with respect to the rhythm "pops", the rhythm pattern datum of pattern number I=1 is such that, for the sounding-out timing corresponding to the first 16-th note, the most significant bit indicates, by "1", the presence of accentuation, while the least significant bit and the fifth bit, by "1", indicate the presence of sounding-out of high hat closed (HHC) and of bass drum (BD), respectively.

Figure 7:
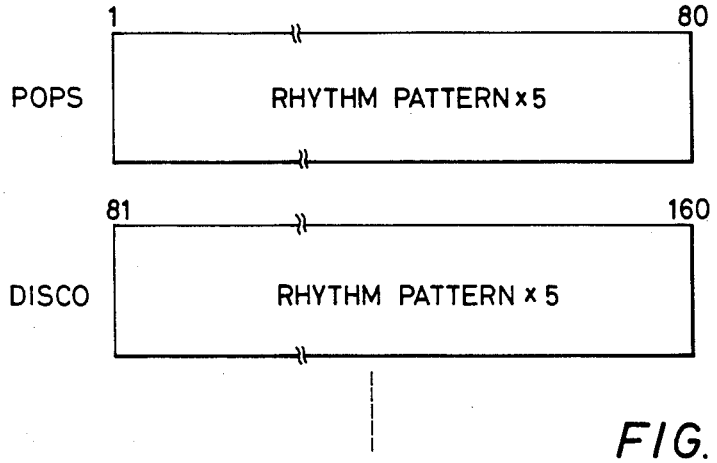
FIG. 7 is a diagrammatic illustration showing the address arrangement in the fourth table.

FIG. 7 shows the arrangement of addresses of the fourth table. One bar (measure) corresponds to sixteen (16) pieces of 16-th notes. Accordingly, if five (5) kinds of rhythm patterns are stored for each type (kind) of rhythm as many as 16×5=80 addresses are required. Thus, with respect to the rhythm "pops", addresses are predetermined to be "1"~"80", and for the rhythm "disco", addresses of "81"~"160" have been predetermined.

FIG. 8 shows the memorized contents of the fifth table in the table memory 22. In this fifth table, there are stored rhythm pattern data indicative of standard rhythm patterns for each type of rhythm with respect to the twelve (12) types of rhythm of the first table. Each rhythm patterns datum represents a datum for one bar (measure) length, and is arranged so that the need or no-need of pronunciation of the six (6) tone generators (instruments) is indicated by either "1" or "0", respectively, for each tone-producing timing corresponding to the 16-th note duration.

WORKING MEMORY 20

Among the counters, registers and like parts which are included in the working memory 20, those associated with automatic rhythm performance are as enumerated below.

(1) Rhythm run flag RUN

This is a one-bit register, which functions that, by turning-on a rhythm start switch 62 of FIG. 2, "1" is set, and that by turning-on a rhythm switch 64 of FIG. 2, "0" is written therein.

(2) Tempo counter CNT

This is assigned to count the tempo clock signals TCL delivered from the tempo clock generator 24, and it assumes count values of "0"~"15", and at the timing when the count value becomes "16", this counter is reset to "0".

(3) Rhythm register N

This is arranged so that, when a desired type of rhythm is selected by the manipulation of a rhythm selection switch of FIG. 2, a rhythm number datum (a datum indicative of the rhythm number "n") which is read out from the first table correspondingly to said selected rhythm.

(4) Tone generator (instrument) register M

This is to store tone generator number data (data indicative of the tone generator number "m") for six (6) tone generators (instruments) which are read out from the second table correspondingly to the rhythm number "n" stored in the rhythm register N. The tone generator number data for these six (6) tone generators (types of instruments) constitute tone generator allotment data.

(5) Custom mode flag CMF

This is comprised of a one-bit register, and is arranged so that when a mode changeover switch 66 of FIG. 2 is turned off, "1" is written in, and when the same switch 66 is turned on, "0" is registered therein.

(6) Pattern number register IR

This is a register to store data indicative of the pattern number "I".

(7) Tone generator group number register JR

This is a register to store data indicative of the tone generator group number J.

(8) Register A

This is an address register which is utilized when either the fourth or fifth table is read out.

(9) Register B

This is a register to store tone generator designation data read out from the third table.

(10) Register C

This is a register to store pattern datum for each one tone-producing timing read out from either the fourth or the fifth table.

(11) Register D

This is a register to store a tone generator driving datum for one tone-producing timing formed based on the datum of either the register C or the register D.

MAIN ROUTINE (FIG. 9)

Figure 9:
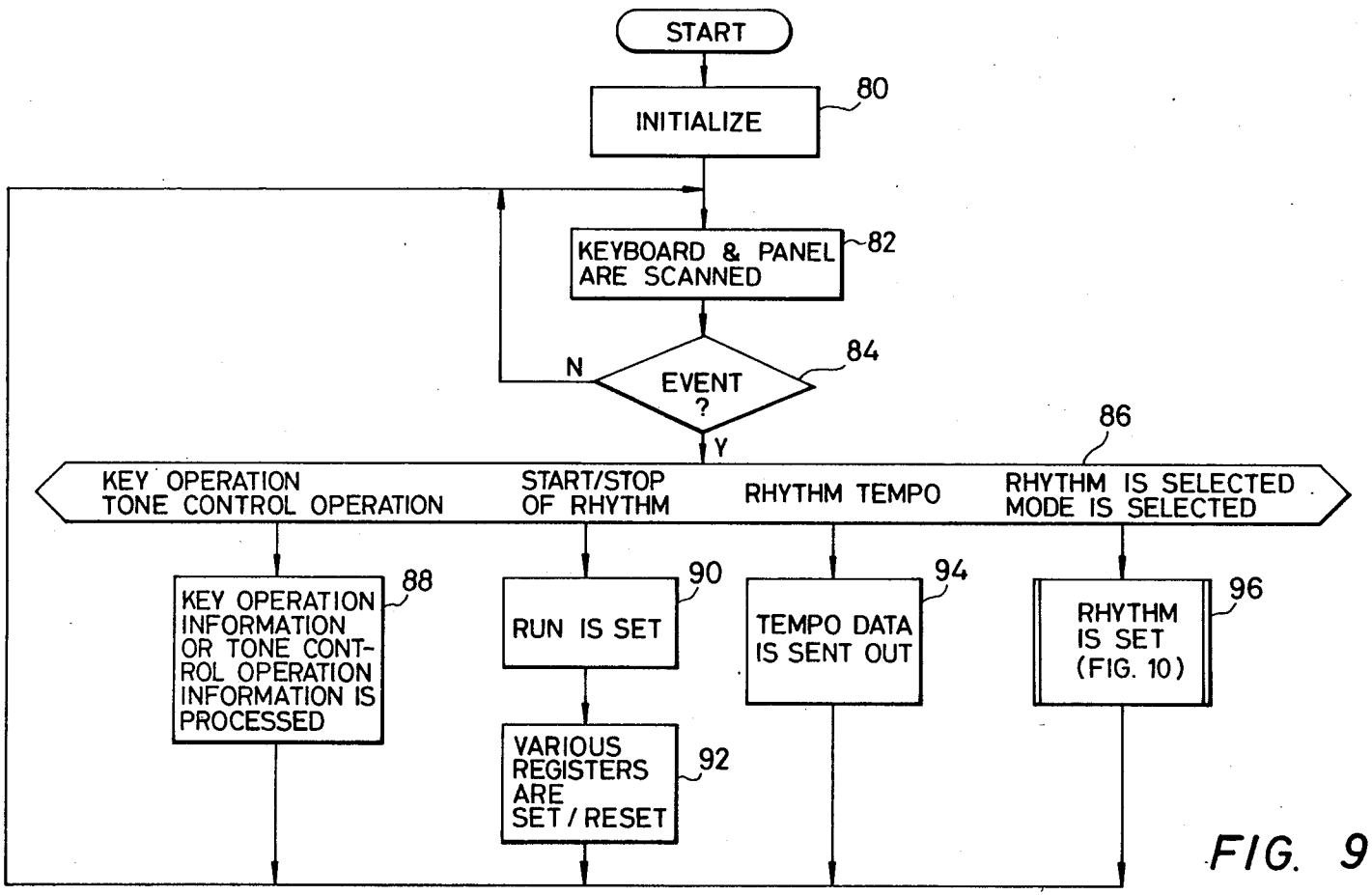
FIG. 9 is a flow chart showing the main routine.

Next, description will be made of the processing of main routine by referring to FIG. 9.

To begin with, in Step 80, an initializing routine is carried out to accomplish initial setting of various registers and like parts. And, processing advances to Step 82, wherein a number of key switches of the keyboard 10 and a number of manipulator knobs of buttons on the control panel face are scanned to detect key actuations and control knobs actuations.

Next, in Step 84, based on the detected key actuation information and knob actuation information, judgment is made whether there is a change in state (event) in respective key switches and respective manipulator knobs. If the result of this judgment indicates no event (N), processing returns to Step 82. If the judgment indicates the presence of an event (y), processing moves to Step 86.

In Step 86, judgment is made of the type of event. And, if the event is one concerning either a key actuation or a tone control knob actuation, processing moves to Step 88, wherein either the key actuation information processing or the tone control knob actuation information processing (actuation information of the knobs 32) is carried out. In case, for example, there is a key actuation, the tone pitch datum corresponding to the depressed key is applied, via the keyboard tone interface 26, to the keyboard tone generating circuit 36. Also, in case there has occurred a tone color selecting operation, the tone color datum indicative of the selected tone color (for example, tone color of organ) is supplied, via the keyboard tone interface 26, to the keyboard tone generating circuit 36. By such a processing, generation of the tones based on the keyboard actuation becomes feasible. Subsequent to Step 88, processing moves back to Step 82.

Now, if the result of judgment in Step 86 indicates that the event is one related to either the start or stop of a rhythm, processing moves to Step 90. In this Step 90, if the rhythm start switch 62 is turned on, "1" is registerd in the rhythm run flag RUN, while if the rhythm stop switch 64 is turned on, "0" is written in this flag RUN. With this, processing moves to Step 92, wherein setting/resetting processing of various registers and like parts accruing from either the start or stop of rhythm is performed. Thereafter, processing returns to Step 82.

If the result of judgment in Step 86 indicates that the event concerns rhythm tempo, processing moves over to Step 94. In this Step 94, a tempo datum TMP in accordance with operation of tempo adjusting switch 52 or 54 of FIG. 2 is delivered out to the tempo clock generator 24, to determine a rhythm tempo. After this, processing returns to Step 82.

In case the result of judgment in Step 86 is such that the event relates to selection of rhythm or selection of mode, processing moves onto Step 96. In this Step 96, the rhythm determining sub-routine is carried out. And, processing returns to Step 82.

RHYTHM SETTING SUB-ROUTINE (FIG. 10)

Figure 10:
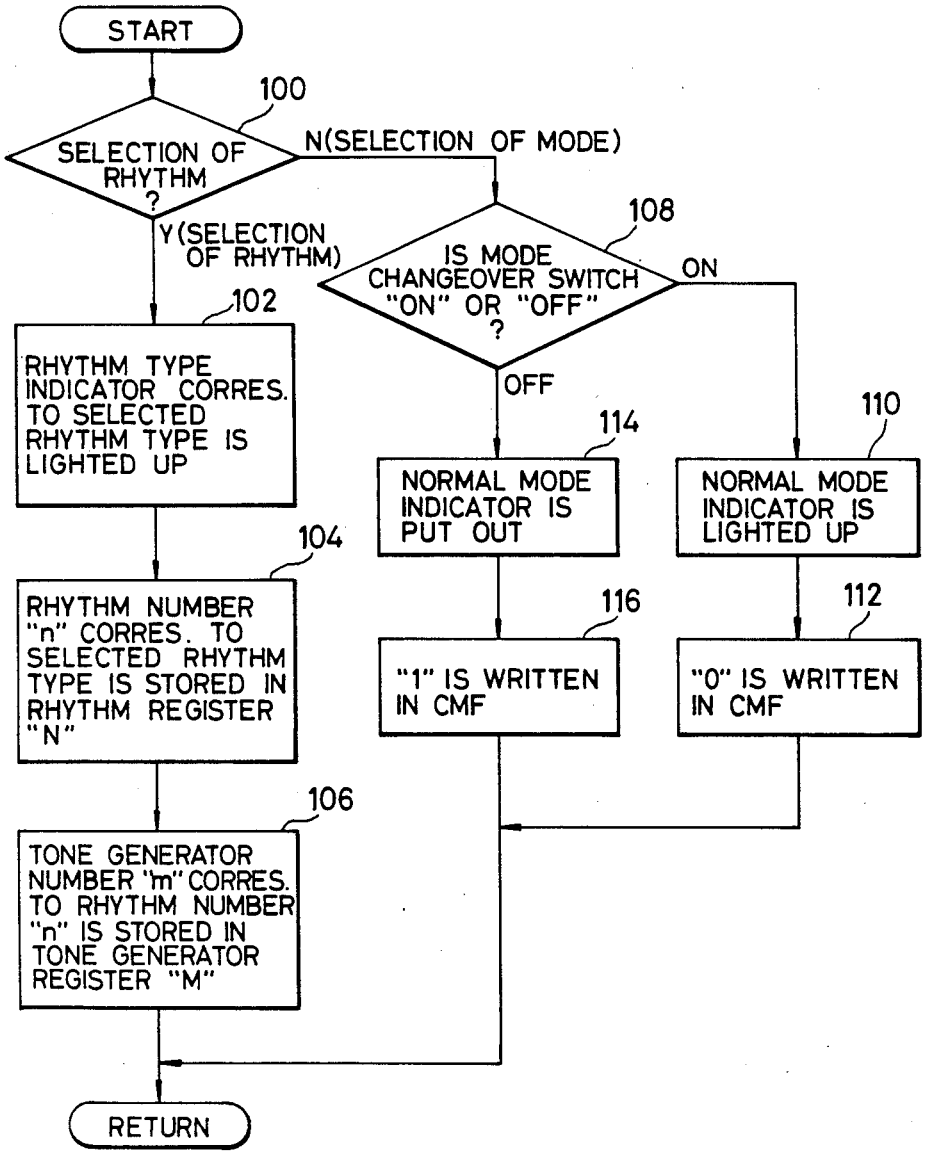
FIG. 10 is a flow chart showing the rhythm setting sub-routine.

In FIG. 10, in Step 100, judgment is made whether the event concerns selection of rhythm. If the result of this judgment is affirmative (Y), processing moves onto Step 102.

In Step 102, among the twelve (12) rhythm kind indicators included in the rhythm kind indicating unit 56 of FIG. 2, the specific one corresponding to the selected rhythm is lighted up.

Next, in Step 104, a rhythm number "n" corresponding to the selected kind of rhythm is read out from the first table and it is stored in the rhythm register N. And, processing moves to Step 106.

In Step 106, the tone generator numbers "m" for six (6) tone generators (instruments) corresponding to the rhythm numbers "n" stored in the rhythm register N are read out from the second table to be stored in the tone generator register M. The tone generator number data for six (6) tone generators (instruments) in this tone generator register M are supplied as the tone generator assignment data to the rhythm tone generating circuit 38 via the rhythm interface 28, and are latched by the latch circuit contained therein. As a result, in the rhythm tone generating circuit 38, six (6) tone generators (instruments) are assigned to the six (6) tone-producing channels in accordance with the latched tone generator assignment data. If, for example, the rhythm "pops" is selected, those tone generators dealing with bass drum, snare drum, middle tom-tom, high hat open, high hat closed, and claves (which are kinds of instruments) are assigned to the tone-producing channels 1, 2, 3, 4, 5 and 6, respectively. Subsequent to Step 106, processing returns to the main routine processing of FIG. 9.

On the other hand, in case the result of judgment in Step 100 is negative (N), this means the presence of an event concerning the selection of mode, so that the processing moves to Step 108.

In this Step 108, judgment is made whether the mode changeover switch 66 is in the state of either "on" or "off". If case the result of this judgment is indicative of "on", processing moves to Step 110, wherein the normal mode indicator 68 is lighted up. And, after "0" is written in the custom mode flag CMF in Step 112, processing returns to the main routine of FIG. 9.

Also, if the result of judgment in Step 108 indicates "off", processing moves onto Step 114, and the normal mode indicator 68 is turned off. And, after "1" is written in the custom mode flag CMF in Step 116, processing returns to the main routine of FIG. 9.

TEMPO INTERRUPT ROUTINE (FIG. 11)

FIG. 11 shows the tempo interrupt routine intended for the generation of rhythm tones. This routine is carried out for each generation of a tempo clock pulse TCL by the tempo clock generator 24, i.e. for each 16-th note timing.

To begin with, in Step 120, judgment is made whether the rhythm run flag RUN indicates "1". If the result of this judgment does not indicate "1" (N), this means that a rhythm stop command is issued, and accordingly no processing is carried out and processing returns to the main routine of FIG. 9.

In case the result of judgment in Step 120 indicates "1" (Y), processing moves to Step 122, wherein pattern number I=1 is written in the pattern number register IR, and processing moves to Step 124.

In Step 124, judgment is made whether the custom mode flag CMF indicates "1". If the result of this judgment does not indicate "1" (N), this means that the normal mode has been selected, so that processing moves to Step 126.

In Step 126, there is carried out a processing of determining the address for reading out the fifth table. That is, there is carried out a calculation: 16n+CNT value+I, and the result of this calculation is written in the register A. Here, "n" represents the rhythm numbers stored in the rhythm register N. By multiplying this rhythm number by the address number "16" per rhythm pattern, the rhythm pattern data of the selected rhythm can be designated. Also, "CNT value" indicates the count value of the tempo counter CNT. By adding this CNT value to "16n", it is possible to designate the pattern data for one tone-producing timing (rhythm timing) in the selected rhythm pattern data. It should be noted here that "I" represents the pattern number stored in the pattern number register IR, and in case of the normal mode, "I" is always "1".

According to such a calculation as mentioned above, it should be noted that, in case, for example, the rhythm "pops" is selected, there is determined an address of the pattern data (e.g. if the CNT value is "0", a datum corresponding to the initial 16-th note) for one tone-producing timing in accordance with the CNT value among the rhythm pattern data n=0 in the fifth table of FIG. 8.

Next, in Step 128, a pattern data for one tone-producing timing is read out from the fifth table based on the address of the register A, and it is stored in the register C. And, after transferring the pattern data of the register C to the register D and storing the data therein in Step 130, processing moves to Step 132.

In Step 132, the pattern data for one tone-producing timing stored in the register D is delivered out, as the tone generator driving data, to the rhythm interface 28. As a result, in the rhythm tone generating circuit 38, a signal tone generator or a plurality of tone generators whose tone production has been instructed by the tone generator driving data is or are driven, and rhythm tones for one tone-producing timing are sounded out from the loudspeaker 42.

Thereafter, after writing "0" in the register D in Step 134, processing moves to Step 136, wherein the count value of the tempo counter CNT is upped by "1". And, in Step 138, judgment is made whether the CNT value is "16". If the result of this judgment is negative (N), processing returns to the main routine of FIG. 9. Also, if the result of judgment in Step 138 is affirmative (Y), the count value of the tempo counter CNT is rendered to "0" in Step 140, and thereafter processing returns to the main routine of FIG. 9.

By repeating such kinds of processing as those mentioned above for each tone-producing timing, it is possible to effect an automatic rhythm performance in accordance with, for example, "pops" rhythm pattern of the fifth table.

Now, in case the result of judgment in Step 124 is affirmative (Y), this means that a custom mode is selected, so that processing moves onto Step 142.

In Step 142, there is carried out a processing to determine the address intended for reading out the fourth table. That is, there is carried out a calculation: $80n+\text{CNT value}\times 5+I$, and the result of this calculation is written in the register A. Here, "n", "CNT value" and "I" are as those described above. The reason for multiplying the rhythm number "n" by "80" is based on the consideration that there are "80" addresses for each kind of rhythm as shown in FIG. 7. Also, the multiplication of the CNT value by "5" is due to the fact that five (5) rhythm patterns have been stored for each kind of rhythm.

According to such calculation as mentioned above, it should be understood that, if, for example, a rhythm "pops" is selected, a rhythm pattern datum of pattern number I is selected from among those rhythm pattern data $n=0$ in the fourth table of FIG. 6, and along therewith, it is possible to determine the address for the pattern datum (for example, if the CNT value is "0", the datum corresponding to the initial 16-th note) for one tone-producing timing complying with the CNT value from among these selected rhythm pattern data.

Next, in Step 144, tone generator group numbers $J=1$ are written in the tone generator group number register JR, and then processing moves onto Step 146, wherein judgment is made whether the rhythm pattern of pattern number I is selected by the pattern selecting lever of the tone generator group number J registered in JR. Here, the pattern selection levers 72A, 72B, 72C and 72D in FIG. 2 correspond to the tone generator group (instrument family) numbers 1, 2, 3 and 4, respectively. If, as stated above, both I and J are set to "1" as an example, judgment in Step 146 will be made whether or not the rhythm pattern of pattern number "1" is selected by the pattern selection lever 72A.

In case the result of judgment in Step 146 is affirmative (Y), processing moves to Step 148. In this Step 148, tone generator designation data is read out from the third table of FIG. 5 based on the rhythm number "n" of the register N and also on the tone generator group number J of the register JR, to be stored in the register B.

Next, in Step 150, pattern data for one tone-producing timing is read out from the fourth table of FIG. 6 based on the address of the register A, and it is stored in the register C. And, processing advances onto Step 152.

In Step 152, there is freshly carried out a processing for forming a tone generator driving data for one tone-producing timing based on the pattern datum for one tone-producing timing stored in the register C and also on the tone generator designation datum stored in the register B. Concretely speaking, corresponding bits of the registers B and C are subjected to AND calculation, and the corresponding bits of the data obtained from said calculation and of the data stored in the register D are subjected to OR computation, and the result of this calculation (computation) is written in the register D.

Next, processing moves onto Step 154, wherein judgment is made whether the tone generator group number J of the register JR is smaller than "4". If the result of this judgment indicates $J<4$ (Y), the tone generator group number J of the register JR is upped by "1" in Step 156. And, processing returns to Step 146, wherein the processing in Steps 146~156 is carried out in a manner similar to that mentioned above. It should be noted here that, in case the result of judgment in Step 146 is negative (N), this means that no specific rhythm pattern has been selected, so that without carrying out the processing of Steps 148~152, processing moves onto Step 154.

In case there is carried out, for the four tone generator groups $J=1\sim4$, the processing of checking whether or not the rhythm pattern of, for example, pattern number $I=1$ has been selected, the result of judgment in Step 154 will become negative (N), so that processing moves onto Step 158. In this Step 158, judgment is made whether the pattern number I of the register IR is smaller than "5". If the result of this judgment indicates $I<5$ (Y), the pattern number I of the register IR if upped by "1" in Step 160. And, processing returns to Step 142, wherein the processing of Steps 142~160 is carried out in a manner similar to that mentioned above.

By carrying out, in a manner described above, for all of the rhythm patterns of $I=1\sim5$, the processing of checking the tone generator groups of $J=1\sim4$ for each rhythm pattern, the result of judgment in Step 158 will become negative (N), and processing moves to Step 132.

Here, description will be made of an example of forming a tone generator driving datum. It should be understood here that this instant example is such that the rhythm "pops" is selected as the type of rhythm desired and that those rhythm patterns of pattern numbers 1, 2, 1 and 4 have been selected by the pattern selection levers 72A, 72B, 72C and 72D, respectively. Also, the tone generator driving datum which is intended to be formed here is assumed to be the one with the tone-producing timing corresponding to the initial 16-th note duration of FIG. 6.

To begin with, when $I=1$ and $J=1$, the contents of the register B are such that, by illustrating the extreme left end one as being the most significant bit (it is to be assumed here that same applies to the other registers also), the datum becomes "10010000" by referring to FIG. 5. Also, the contents of the register C will become "10010001" from FIG. 6. When the processing of Step 152 is carried out based on the contents of these two registers, the contents of the register D will become "10010000" since the initial value of the contents thereof is "0".

Next, when $I=1$ and $J=3$, the contents of the register B are "00000011" as noted from FIG. 5, while the contents of the register C are the same as those noted in case J=1. By carrying out the processing of Step 152 based on the contents of these two registers, the contents of the register D will become "10010001".

Next, when I=2 and J=2, the contents of the register B becomes "00001100" from FIG. 6. By carrying out the processing of Step 152 based on the contents of these two registers, the result of the AND calculation will be show that all bits become "0". Therefore, the contents of the register D remain to be "10010001".

Next, when I=4 and J=4, the contents of the register B are "00100000" from FIG. 5, while the contents of the register C are "10110001" from FIG. 6. By carrying out the processing of Step 152 based on these contents of the two registers, the contents of the register D will become "10110001". These contents of the register D at such a time will correspond, as shown by those enclosed with rectangular frames, to those bits arranged correspondingly to "1" in the tone generator designation data of J=1~4 as extracted from the pattern data I=1, 2 and 4 in FIG. 6.

The datum "10110001" of the register D obtained in such a manner as mentioned above is delivered out, as the tone generator driving datum at the tone-producing timing corresponding to the initial 16-th note duration, to the rhythm interface 28 in Step 132. Accordingly, at this tone-producing timing, those tones of claves, bass drum and high hat closed with accentuation (in a relatively large tone volume) are sounded out from the loudspeaker 42.

By repeating such data-forming processing as stated above for each tone-producing timing, it is possible to realize an automatic rhythm performance with those custom patterns determined by the lever 72A~72D.

In the custom mode operation, those kinds of processing of Step 132 and onwards are similar to those already described with respect to the normal mode operation.

MODIFIED EXAMPLES

The present invention is not limited to the above-described embodiment, but it may be put to practice in various modified manners. Some of such modified examples will be shown below.

(1) In the routine of FIG. 11, arrangement is provided so that, after carrying out, for all of the rhythm patterns, the processing of checking a plurality of tone generator groups one after another for each rhythm pattern, the tone generator driving datum of the register D is delivered out to the rhythm interface. However, there may be provided an arrangement such that a plurality of tone generator groups are checked one after another for each rhythm pattern, and that for each formation of tone generator driving datum accruing from the judgment that there has been present the selection of said rhythm pattern, said tone generator driving datum is delivered out to the rhythm interface. By doing so, there are supplied, to the rhythm interface, tone generator driving data only as many times as the number of tone generator groups for each tone-producing timing. Therefore, from a microscopical aspect, there could occur a slight shifting of tone generator driving timing. However, it is not possible for human ears to recognize or discriminate such subtle shifting of timing because of an extremely high-speed processing, and accordingly there is noted no inconvenience in the practical function.

(2) In the routine of FIG. 11, there is provided the arrangement that the plurality of tone generator groups are checked one after another for each rhythm pattern. This system may be modified to the arrangement that a plurality of rhythm patterns are checked one after another for each tone generator group. In such a modification also, it is possible to deliver out tone generator driving datum a plurality of times for each tone-producing timing in such a manner as described in the above-mentioned item (1).

(3) In the above-described embodiment, arrangement is provided so that those rhythm pattern data corresponding to a plurality of rhythm patterns which are selectable for each tone generator group are stored in ROM. However, there may be provided RAM in place of this ROM, so that the user may determine or register an arbitrary pattern in said RAM, or that the user may be allowed to make local alteration or modification of the already registered ryhthm pattern. By so doing, a rhythm performance richer in variation becomes possible.

As described above, according to the present invention, arrangement is provided so that, from among a plurality of rhythm patterns, an arbitrary one or ones are selected for the tone generator or generators in each tone generator group, to determine a tone generator driving pattern for each tone-producing timing. As a result, there is obtained a unique effect that a rhythm performance rich in variation can be realized with a reduced memory capacity and by a simplified manipulation on the control panel board.

What is claimed is:

1. An automatic rhythm performing apparatus for an electronic musical instrument, comprising:

(a) rhythm pattern memory means storing data constituting a plurality of rhythm patterns indicating timings for rhythm instrument tones, said rhythm patterns being provided for plural rhythms, each of said rhythms being composed with plural instrument tones, plural rhythm patterns being provided for each of said plural instrument tones;

(b) instrument family memory means storing data designating families to which respective ones of said instrument tones belong, thus dividing said plural instrument tones into a smaller number of instrument families;

(c) rhythm pattern selecting means, respectively provided for said instrument families, for selecting a desired rhythm pattern from among said plurality of rhythm patterns for each of said instrument tones with respect to each individual instrument family wherein respective rhythm patterns are gang-operatedly selected for respective instrument tones, one pattern for one instrument, with respect to all instrument tones included in one instrument family to which the rhythm pattern selecting means is assigned;

(d) driving data forming means for forming tone generator driving data indicating which one or ones of said instrument tones is or are to be driven at an individual rhythm timing, based on the rhythm pattern data of the rhythm patterns selected by said rhythm pattern selecting means and designated by the data designating any one or ones of said families; and (e) tone generator means for generating respective rhythm instrument tones by being selectively driven in accordance with said tone generator driving data.

2. An automatic rhythm performing apparatus according to claim 1, in which:

said rhythm patterns include standard mode rhythm patterns and modified custom mode rhythm patterns.

3. An automatic rhythm performing apparatus according to claim 1, in which each family comprises a single instrument tone.

4. An automatic rhythm performing apparatus according to claim 1, in which each family comprises a plurality of instrument tones.

5. An automatic rhythm performing apparatus according to claim 1, in which certain families among the plurality each comprises a single instrument tone and the other families each comprise a plurality of instrument tones.

* * * * *